US006788547B2

(12) United States Patent
Moden

(10) Patent No.: US 6,788,547 B2
(45) Date of Patent: Sep. 7, 2004

(54) METHOD OF MAKING ELECTRICAL CONTACT DEVICE

(75) Inventor: Walter Moden, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/615,905

(22) Filed: Jul. 10, 2003

(65) Prior Publication Data

US 2004/0027815 A1 Feb. 12, 2004

Related U.S. Application Data

(62) Division of application No. 09/511,692, filed on Feb. 23, 2000, now Pat. No. 6,625,885, which is a division of application No. 09/132,248, filed on Aug. 11, 1998, now Pat. No. 6,179,659.

(51) Int. Cl.[7] ..... H01R 9/00

(52) U.S. Cl. ..... 361/772; 361/773; 29/843; 29/841; 257/260; 257/784

(58) Field of Search ..... 361/772, 773, 361/776; 29/827, 825, 841, 843; 174/52.1; 257/260, 784, 780

(56) References Cited

U.S. PATENT DOCUMENTS

| | | | | |
|---|---|---|---|---|
| 3,500,295 A | | 3/1970 | Faber et al. | |
| 3,746,157 A | | 7/1973 | I'Anson | |
| 4,132,856 A | * | 1/1979 | Hutchison et al. | 174/52.2 |
| 4,435,741 A | | 3/1984 | Shimizu et al. | |
| 4,536,825 A | | 8/1985 | Van Dyk Soerewyn | |
| 4,689,875 A | | 9/1987 | Solstad | |
| 4,918,513 A | | 4/1990 | Kurose et al. | |
| 5,104,820 A | | 4/1992 | Go et al. | |
| 5,260,234 A | | 11/1993 | Long | |
| 5,438,481 A | | 8/1995 | Murphy et al. | |
| 5,495,667 A | | 3/1996 | Farnworth et al. | |
| 5,587,336 A | | 12/1996 | Wang et al. | |
| 5,631,193 A | | 5/1997 | Burns | |
| 5,663,598 A | | 9/1997 | Lake et al. | |
| 5,686,318 A | | 11/1997 | Farnworth et al. | |
| 5,693,565 A | | 12/1997 | Camilletti et al. | |
| 5,725,392 A | | 3/1998 | Bianca et al. | |
| 5,762,521 A | | 6/1998 | Tanaka et al. | |
| 5,802,709 A | | 9/1998 | Hogge et al. | |

FOREIGN PATENT DOCUMENTS

| | | |
|---|---|---|
| FR | 1364127 | 5/1964 |

* cited by examiner

*Primary Examiner*—David Martin
*Assistant Examiner*—Hung S. Bui
(74) *Attorney, Agent, or Firm*—Dickstein Shapiro Morin & Oshinsky LLP

(57) ABSTRACT

The invention provides an electrical contact device, a pre-assembly for producing the electrical contact device, and a method of forming the electrical contact device. The electrical contact device includes a plurality of fine pitch electrical leads disposed in parallel spaced apart relation. An insulating member encapsulates portions of the electrical leads which extend from opposite sides of the insulating member. The insulating member retains the electrical leads in position and electrically isolated from one another. The contact device is used to facilitate connection with the leads of an IC package.

10 Claims, 4 Drawing Sheets

METHOD OF MAKING ELECTRICAL CONTACT DEVICE

This application is a divisional of application Ser. No. 09/511,692 filed on Feb. 23, 2000, now U.S. Pat. No. 6,625,885 which is a divisional of Ser. No. 09/132,248, filed on Aug. 11, 1998 (now U.S. Pat. No. 6,179,659), which are hereby incorporated by reference.

BACKGROUND OF THE INVENTION

1. Field of the Invention

The present invention relates to electrical contacts, and particularly to fine pitch electrical contacts. More particularly, the invention relates to fine pitch contacts for connecting the leads of a packaged integrated circuit (IC) to a printed circuit board, a circuit tester or the like.

2. Discussion of the Related Art

Fine pitch contacts are often used to connect packaged IC circuits to test boards, test fixtures, or the like. For example, in a known IC tester, a clam shell fixture for receiving an IC is attached to a tester circuit. The fixture includes a bottom portion having an array of leads and an upper pivoting cover portion. The packaged IC circuit is placed on the lower portion with its contacts being in contact with the array of leads. When the packaged circuit is in correct position, the lid of the clam shell is closed over the packaged IC circuit, holding the IC circuit in position with the leads of the IC circuit being connected with the arrays of leads.

In the past, the bottom portion of the clam shell fixture often included staggered pogo pins as the leads. The pogo pins were miniature upside down pogo sticks installed in a plastic or ceramic clam shell. Each pin was mounted in the clam shell with a tiny spring, with the case holding the spring in place. Another type of known IC tester uses a finely machined fixture that contains parallel metal slides disposed in slots at the correct pitch. In this arrangement, the outer portion of the slides provided the contact with an IC package for testing.

While conventional contacts for connecting with the leads of an IC package for testing or other purposes have proven to be adequate, they are also often structurally complex and expensive to produce.

In addition, conventional contacts tend to be application specific. That is, if the leads from the IC circuit package require a different length, the fine pitch lead package must be redesigned to accommodate the new length. Moreover, the contacts are typically at the same pitch as the leads of the IC package making it difficult sometimes to connect the contacts to test and other circuits.

SUMMARY OF THE INVENTION

The present invention overcomes the disadvantages of conventional lead packages by providing a simple and inexpensive conductor package which can connect with the leads of an IC package to interface those leads with other circuits for testing or other purposes. The conductor package has an insulating member and an array of individual leads extending in opposite directions from the insulating member. The insulating member may be part of an insulating frame which has one or two insulating members, each insulating member containing its own array of individual leads extending from opposite sides thereof.

Each array of leads is adapted for permanent or removable connection to the leads of an IC package as well as to the leads of a circuit board or a test fixture. The conductor package may also be used to mount and connect packaged IC's to other packaged IC's, if desired.

The invention also provides a unique method for fabricating a pre-assembly for making a final conductor package, as well as the final conductor package itself. In another aspect the invention also provides a pre-assembly incorporating a pre-punched lead frame having molded insulation areas to facilitate manufacture of the conductor package.

These and other features and advantages of the invention will become more apparent from the following detailed description of preferred embodiments of the present invention which is provided in connection with the accompanying drawings.

DETAILED DESCRIPTION OF PREFERRED EMBODIMENTS

Figure 1:
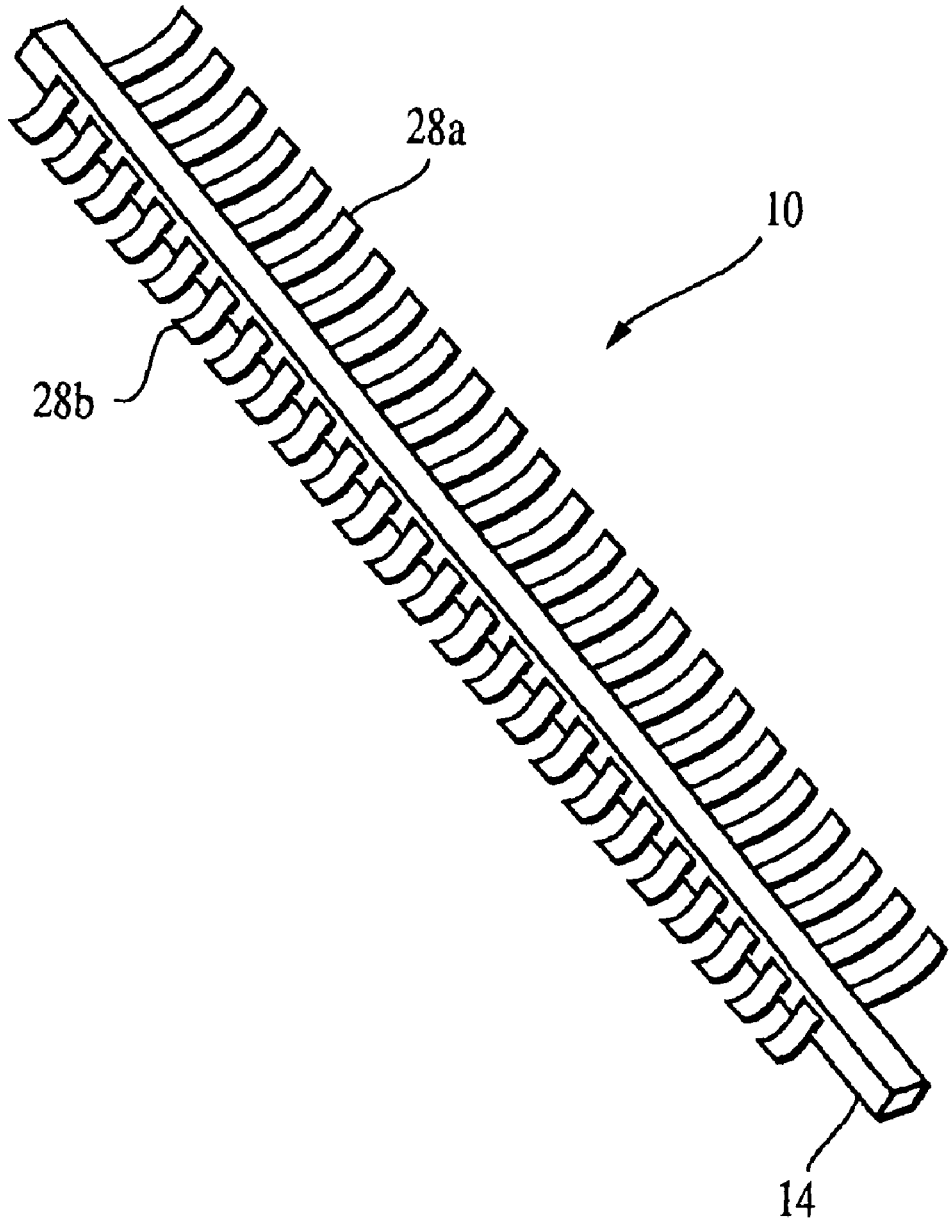
FIG. 1 is a perspective view of a fine pitch electrical contact package constructed according to the present invention.

FIG. 1 illustrates a electrical contact package 10 constructed in accordance with a first embodiment of the present invention. It includes a plurality of regularly spaced electrical conductors held rigidly in position by an insulating member 14. Each of the separate conductors has two leads 28*a* and 28*b* which respectively extend from opposite sides of insulating member 14. The leads 28*a*, 28*b* are held rigidly in place by member 14, as they extend out from opposite sides of insulating member 14 and can be bent to meet the requirements of many different circuit packages. The leads 28*a* on one side of the member 14 may be made longer than the leads 28*b* on the opposite side of insulating member 14. The leads 28*a* may also be bent into a different configuration than leads 28*b*.

Figure 2:
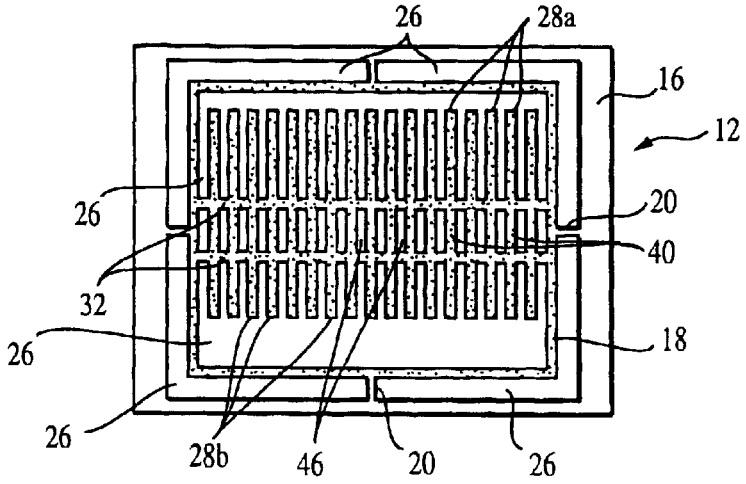
FIG. 2 is a plan view of a conducting lead frame used to form the FIG. 1 structure.
Figure 3:
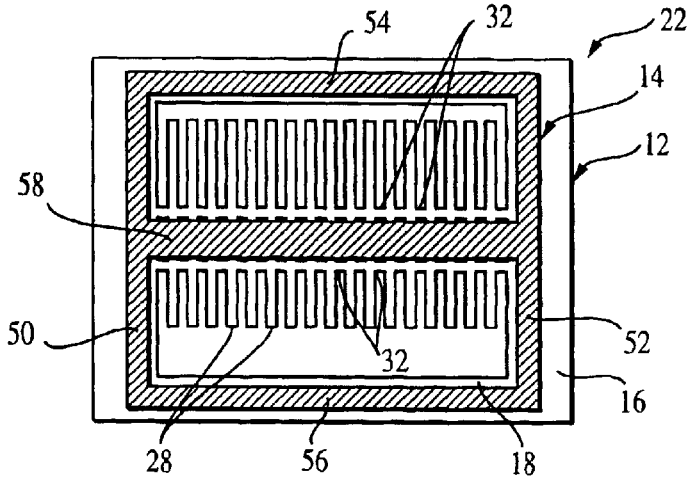
FIG. 3 is a plan view of the conducting lead frame of FIG. 2 with encapsulating material added thereto.
Figure 4:
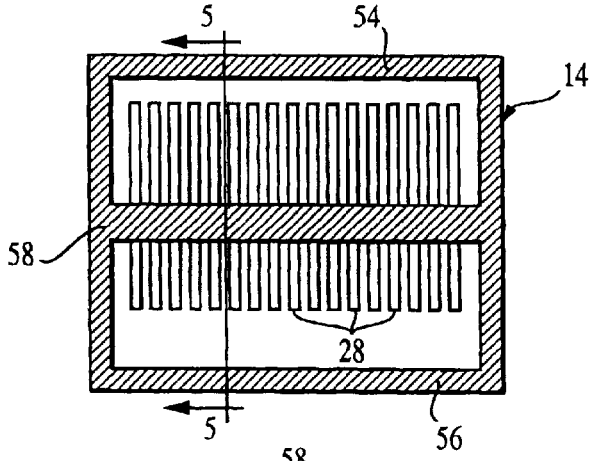
FIG. 4 is a plan view of the conducting lead frame of FIG. 3 with portions of the metal framework removed.

The manner in which the electrical contact package 10 is formed is illustrated by FIGS. 2–4. The electrical contact package 10 includes a conducting frame 12, illustrated in FIG. 2, and an insulating frame 14 which is added to predetermined portions of the conducting frame 12 to form the pre-assembly 22 illustrated in FIG. 3. Predetermined portions of the conducting frame 12 are removed from the FIG. 3 pre-assembly to yield the electrical contact package 10, illustrated in FIGS. 4 and 5.

Referring back to FIG. 2, the conducting frame 12 includes an outer conducting frame 16, an inner conducting frame 18, a plurality of conducting frame connectors 20, a plurality of electrical leads 28*a* and 28*b*, and a plurality of electrical lead connecting strips 32. The inner and outer conducting frames 16, 18 are connected to each other by the plurality of frame connectors 20. The inner and outer frames 16, 18 and the frame connectors 20 cooperate to define a plurality of frame slots 26, that is, areas where no conductors are present. The plurality electrical leads 28*a* and 28*b* are disposed in parallel arrangement and are connected to each other and to the inner frame 18 by the plurality of connecting strips 32. The connecting strips 32 are preferably disposed orthogonally to the electrical leads 28*a*, 28*b* and divide each electrical lead into a first end portion 28*a,* a second end portion 28*b*, and a center portion 40. The center portions of the electrical leads 28 cooperate with the connecting strips 32 to define a plurality of inner frame slots 46. The FIG. 2 structure is formed by stamping out a thin strip of conductive material into the pattern shown in FIG. 2.

As illustrated in FIG. 3, a conventional electrically insulating material, such as a plastic epoxy is applied to conducting frame 12, for example, by transfer thermal molding. The applied insulating material forms the insulating frame 14. The electrically insulating frame 14 includes right and left side members 50, 52, respectively, top and bottom cross members 54, 56, respectively, and a center bridging cross member 58. The side members 50, 52 and the top and bottom cross members 54, 56 are formed when the electrically insulating molding material moves in and through the frame slots 26, 46 during the transfer molding process. When the insulating material hardens, the conducting frame 12 is rigidly retained to the insulating frame 14. The bridging cross member 58 of the electrically insulating frame 14 are likewise formed during the transfer molding process by having the insulating material flow in and through the inner slots 46 and on both sides of the center portions 40 of the fine pitch electrical leads 28*a*, 28*b*. The electrical leads 28*a*, 28*b* are rigidly held in place by the hardened insulating material. Importantly, as illustrated in FIG. 3, the connecting strips 32 are fully exposed after the bridging cross member 58 is formed. As a matter of choice, the inner and outer frames 16, 18 can be completely covered by the insulating material forming the left and right side members 50, 52 and the top and bottom cross members 54, 56, or portions of the inner frame 16 and/or the outer frame 18 can be exposed.

As illustrated in FIG. 4, portions of the conducting frame 12 are now removed from the FIG. 3 pre-assembly 22 so that the pre-assembly 22 of FIG. 3 is converted into the electrical contact package 10 illustrated in FIG. 1. This is accomplished by removing the connecting strips 32 from between the fine pitch electrical leads 28*a*, 28*b* by cutting or etching. Since the connecting strips 32 are the only remaining electrical connection between the individual electrical leads 28, removing the connecting strips 32 electrically isolates the individual electrical leads 28 from each other, as illustrated in the cross section of FIG. 5. Of course, if it is desired to have two adjacent leads carry the same signal, the connecting strips 32 connecting the two adjacent leads can be retained. If portions of the inner and outer frames 16, 18 were left exposed after formation of the insulating frame 14, the exposed portions can be removed at the same time, as is illustrated in FIG. 4.

Figure 5:
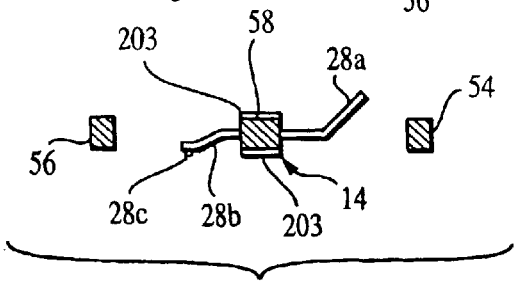
FIG. 5 is a section view taken along lines 5—5 of FIG. 4.

FIG. 5 shows a sectional view of the FIG. 4 structure after the leads 28*a* and 28*b* are bent into a predetermined configuration for use. As shown, the longer lead 28*a* has a bend directing the distal end of lead 28*a* upward, while the shorter lead 28*b* is bent downward and includes a flat portion 28*c* for surface bonding to, for example, a printed circuit board. The FIG. 5 structure can be used as is to interconnect with IC packages or the top and bottom cross members 54 and 56 and side frames 50 and 52 can also be removed leaving just the bridging cross member 58 which now becomes the only remaining part of insulating frame 14 which supports the leads 28*a* and 28*b*, as shown in FIG. 1.

Figure 6:
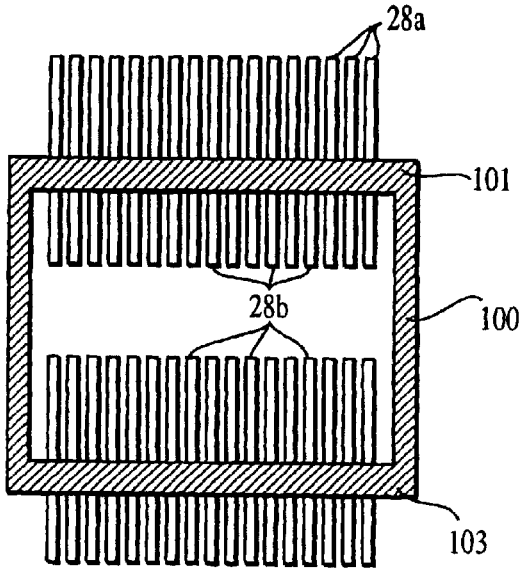
FIG. 6 is a plan view of an alternative configuration of the fine pitch electrical contact package.

It will be appreciated that other arrangements of the pitch electrical leads 28*a*, 28*b* are possible. FIG. 6, for example, illustrates a second embodiment of the invention in which two separate sets of fine pitch electrical leads 28*a*, 28*b* extending from the inside to the outside of top 101 and bottom 103 cross members of a lead frame 100.

Figure 7:
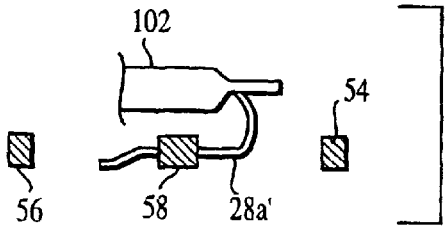
FIGS. 7, 8 and 9 are section views similar to FIG. 5 illustrating alternative configurations of the leads of the fine pitch electrical contact package.
Figure 8:
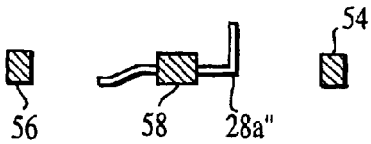
Figure 9:
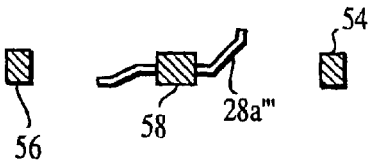

Advantageously, the fine pitch electrical leads 28 can be bent to any desired configuration after they are set in the insulating material. FIGS. 7–9 illustrate possible alternate lead configurations to that illustrated in FIG. 5. In FIG. 7, the longer leads 28*a'* are curved in the form of a C curve in an upward direction, while in FIG. 8 the longer leads 28*a*" have a right angle bend and extend straight up. In FIG. 9 the distal end of the longer leads 28'" also extend straight up after undergoing two bends. FIG. 7 also illustrates a circuit package 102 which is placed on the electrical leads 28*a*' for testing.

Figure 10:
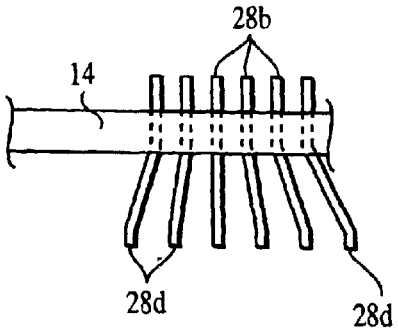
FIG. 10 is a partial plan view of the contact package of FIG. 1 with the fine pitch electrical leads fanned out on one side of an insulating member.

Another embodiment of the present invention is illustrated in FIG. 10, wherein the electrical leads 28*d* are fanned out to provide a different pitch on opposite sides of the supporting insulating member 58.

It will be understood that conventional stamping and punching techniques can be used to stamp out the conducting frame 12 from a thin strip of conducting material and bend the leads 28*a*, 28*b*. Likewise, conventional encapsulation techniques can be used to form the insulating frame 14 on the conducting frame 12. Conventional etching or machining techniques can also be used to remove the connecting strips 32 from between electrical leads 28. Any exposed portions of the inner and outer frames 16, 18 that should be removed can also be removed using these techniques.

One or both sides of the insulating member 14 may also be coated with a conductor 203, if desired, as also shown in FIG. 5.

Figure 11:
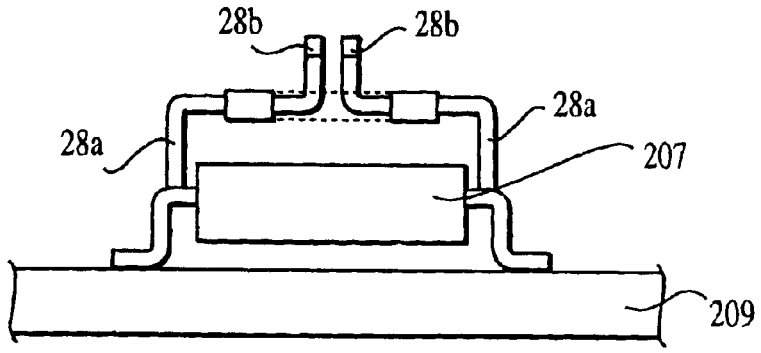
FIGS. 11, 12, and 13 illustrate use of various embodiments of the invention with IC packages.
Figure 12:
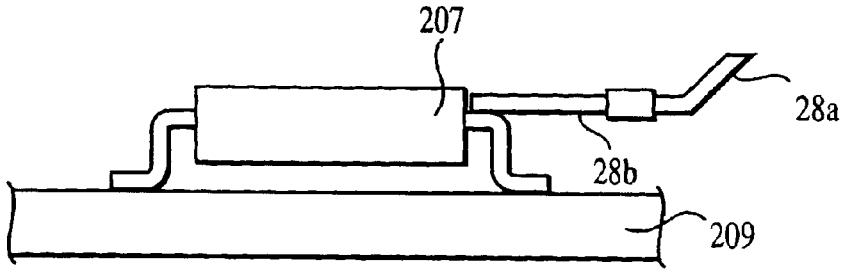
Figure 13:
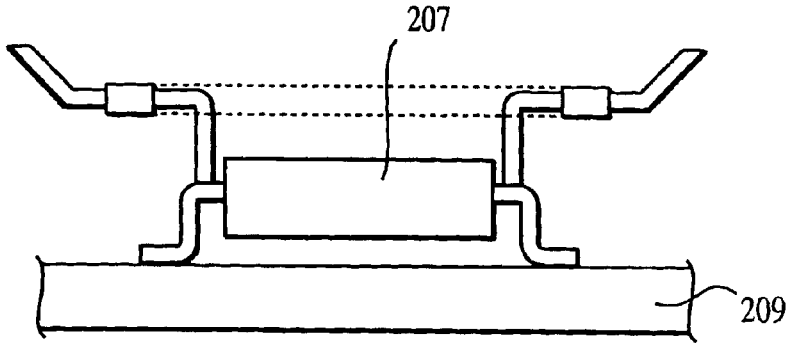

FIGS. 11, 12 and 13 illustrate potential uses for the invention. FIG. 11 shows the FIG. 6 embodiment of the invention mounted, e.g., by soldering, on top of an IC package 207 to facilitate access to IC package leads for testing or other purposes. The IC package 207 is surface mounted, e.g. by soldering to a printed circuit board 207. FIG. 12 illustrates the FIG. 1 embodiment of the invention mounted in cantilevered fashion to an IC package 207, while FIG. 13 illustrates the FIG. 6 embodiment bonded to an IC package 207. Many other arrangements are also possible. The electrical contact package shown in FIG. 1 can also be cut to any desired length needed for a particular application.

The above descriptions and drawings are only illustrative of the preferred embodiments of the invention, and are not intended to describe all changes and modifications which can be made, but which are still part of the invention. Accordingly, the invention is not to be considered as limited by the foregoing description, but is only limited by the scope of the appended claims.

What is claimed is:

1. A method of making an electrical contact device comprising the steps of:

forming a plurality of spaced apart electrical leads held in position relative to each other by at least two conductive connecting strips, said at least two conductive connecting strips extending between adjacent leads and arranged along opposite sides of a plurality of slots formed between said at least two conductive connecting strips, said plurality of spaced apart electrical leads extending outward from said at least two conductive connecting strips;

forming insulating material over said plurality of slots and between said connecting strip; and subsequently removing portions of at least two conductive connecting strips located between adjacent leads to electrically isolate said adjacent leads.

2. The method of claim 1, further comprising a step of bending said electrical leads into a predetermined configuration.

3. The method of claim 2, wherein said predetermined configuration includes a non-parallel configuration.

4. The method of claim 2, further comprising a step of severing said bridging member from said insulating frame.

5. The method of claim 1, wherein said insulating material forms a bridging member, said bridging member being integral with an insulating frame surrounding said electrical leads.

6. A method of making an electrical contact device comprising the steps of:

forming at least two lead structures, each of said lead structures comprising a plurality of spaced apart electrical leads held in position relative to each other by at least two conductive connecting strips, said at least two conductive connecting strips extending between adjacent leads and arranged along opposite sides of a plurality of slots formed between said at least two conductive connecting strips, said plurality of spaced apart electrical leads extending outward from said at least two conductive connecting strips;

said at least two lead structures being connected to one another by an outer frame;

forming insulating material along and between a longitudinal length of, but not covering, each of said at least two connecting strips of each of said lead structures; and subsequently removing portions of each of said at least two connecting strips located between adjacent leads for each of said lead structures.

7. The method of claim 6, wherein said electrical leads and said at least two connecting strips of said at least two lead structures are formed of the same conductive material.

8. The method of claim 7, wherein the step of removing portions of at least two connecting strips includes the step of electrically isolating adjacent leads.

9. The method of claim 6, further comprising a step of bending said electrical leads into a predetermined configuration.

10. The method of claim 6, further comprising a step of severing said two lead structures from said outer frame.

* * * * *